US008361596B2

(12) United States Patent
Mayade

(10) Patent No.: US 8,361,596 B2
(45) Date of Patent: Jan. 29, 2013

(54) SHEET HAVING A ROUGH FEEL

(75) Inventor: Thierry Mayade, Saint Beron (FR)

(73) Assignee: Arjo Wiggins Rives, Rives sur Fure (FR)

( * ) Notice: Subject to any disclaimer, the term of this patent is extended or adjusted under 35 U.S.C. 154(b) by 1302 days.

(21) Appl. No.: 10/497,529

(22) PCT Filed: Dec. 4, 2002

(86) PCT No.: PCT/FR02/04168

§ 371 (c)(1),
(2), (4) Date: Dec. 21, 2004

(87) PCT Pub. No.: WO03/048455

PCT Pub. Date: Jun. 12, 2003

(65) Prior Publication Data

US 2005/0106357 A1 May 19, 2005

(30) Foreign Application Priority Data

Dec. 4, 2001 (FR) ..... 01 15661

(51) Int. Cl.

| | |
|---|---|
| ***D06N 7/04*** | (2006.01) |
| ***E01F 9/04*** | (2006.01) |
| ***G11B 5/64*** | (2006.01) |
| ***B32B 3/00*** | (2006.01) |
| ***B32B 5/16*** | (2006.01) |
| ***B32B 7/00*** | (2006.01) |

(52) U.S. Cl. ..... 428/143; 428/141; 428/206; 428/326

(58) Field of Classification Search ..... 428/141, 428/143

See application file for complete search history.

(56) References Cited

U.S. PATENT DOCUMENTS

| | | | | |
|---|---|---|---|---|
| 3,615,751 | A * | 10/1971 | Lecha et al. | 106/31.39 |
| 4,849,265 | A | 7/1989 | Ueda et al. | |
| 5,093,159 | A * | 3/1992 | Fernandez et al. | 427/342 |
| 5,314,753 | A * | 5/1994 | Bergmann | 428/511 |
| 6,077,392 | A * | 6/2000 | Ruch | 162/135 |
| 6,572,951 | B2 | 6/2003 | Hasegawa et al. | |

FOREIGN PATENT DOCUMENTS

| | | |
|---|---|---|
| EP | 1138510 B1 | 1/2006 |
| FR | 2791368 A1 | 9/2000 |
| GB | 1401533 A | 7/1975 |
| WO | 01/57315 A2 | 8/2001 |

OTHER PUBLICATIONS

Basis Weight to Grammage Calculator, Case Paper Company, Author Unknown, Nov. 29, 2011.*

* cited by examiner

*Primary Examiner* — David Sample
*Assistant Examiner* — Nathan Van Sell
(74) *Attorney, Agent, or Firm* — Westerman, Hattori, Daniels & Adrian, LLP

(57) ABSTRACT

The present invention relates to a sheet having a rough surface feel on at least one of its sides, said sheet being coated on one or both sides with a layer comprising incompressible particles that are not flat and not very angular. It also relates to the process for manufacturing said sheet and to its use as a paper or plastic printing medium, a paper or plastic package, a cover intended for bookbinding, or a board or plastic box.

23 Claims, 10 Drawing Sheets

SHEET HAVING A ROUGH FEEL

BACKGROUND ART

The present invention relates to a sheet having a rough feel.

It also relates to the process for manufacturing the sheet and to the use of this sheet.

The Applicant was interested in particular in providing a sheet which, without being very rough or abrasive, nevertheless has a certain granular aspect that can only be sensed by touch, its surface appearing perfectly smooth to the naked eye.

Research into a certain rough feel remains, to the knowledge of the Applicant, an unexplored field in the paper industry, in thin-film plastics, in packaging or in publishing in general.

This is because, until now, research carried out in these fields had on the contrary been applied to giving a sheet softness or velvety characteristics.

Thus, in Patent FR 2 791 368, the Applicant has protected a sheet having a feel allowing a specific characteristic of the contents of a package to be recalled, in particular for packaging cosmetic products.

SUMMARY OF THE INVENTION

The aim of the Applicant is to provide a sheet with a rough but pleasant feel, that is to say one on which one's finger does not catch.

The sheets must furthermore be able to be printed on, have whiteness features and be able to be handled, for example.

The Applicant has sought particles that meet these objectives.

The Applicant has discovered two broad categories of particles:

- those for which the abrasive role predominates and which have an angular microscopic finish and a somewhat homogeneous distribution on the surface of the sheet, such as alumina or corundum; and
- those for which the spacer and abrasion resistance role is sought, and which have a more rounded microscopic finish and a more bulky form, such as starch.

In its research into a rough feel, the Applicant focused as a priority on using particles from the latter category mentioned, so as to reduce as far as possible the catching of one's fingers on the sheet thus covered.

It has found that the rough effect results in fact from several causes:

- the particle size of the particles used, that is to say their size distribution;
- the shape of the particles used;
- the amount of particles deposited; and
- the distribution of the particles used on the sheet.

It has also found that the most beneficial results are obtained by coating a paper or plastic sheet using a layer of nongelatinized starch particles, and preferably potato starch particles.

By looking in a scanning electron microscope, it is easy to see that the potato starch grains are of almost spherical or oval shape, possess a mean size distribution of 28 micrometers and consist of coarse but not very numerous particles.

The Applicant has also been able to show that the "rough" feel is not obtained with all types of starch, in particular that coating with corn starch grains does not give the desired rough sensation.

The explanation stems from the fact that the particles are small, their mean diameter lying below 15 micrometers, and their particle size distribution being rather little differentiated.

Corn starch grains therefore spread out as a uniform layer, following the relief of the sheet to which they are applied.

From these various analyses, the Applicant has drawn a number of conclusions, allowing the type of particles that can be used to be restricted.

Firstly, the particles must be sufficiently coarse to be able to be flush with the layer, so as to be perceived by the handler.

Next, the particles must not be very angular, so as to create a slightly rough, but pleasant, feel.

In particular, the silica or corundum grains such as those employed for manufacturing abrasives are not suitable for the desired feel, the particles having a fractured geometry that is too aggressive.

Preferably, the particles will have a relatively spherical and bulky geometry, which also excludes particles in flake form, such as talc.

Finally, the particles must not be deformable.

Thus, materials such as rubber or expanded microspheres are not suitable because of their compressible and elastic character, giving the coated sheet a sticky feel and one that is not rough.

From this standpoint, certain starch grains seem to provide a preferential solution as regards their suitability for meeting the abovementioned conditions, and because of their cost, their availability in the natural state, and their recyclability.

To be specific, the invention relates to a sheet having a rough surface feel on at least one of its sides, said sheet being coated on one or both sides with a layer comprising incompressible microscopic particles that are bulky and have a rounded shape.

In particular, the invention is characterized in that the particles have a weight-average diameter of greater than 25 micrometers and preferably less than 200 micrometers.

In particular, the invention is characterized in that the particles have an almost spherical shape.

Preferably, the particles are nongelatinized starch grains, especially potato starch grains.

According to one particular case, the particles may also be glass microspheres, or ground plastic, the plastic preferably being a polyamide, a polyester, a polyolefin or a PVC.

The invention is particularly characterized in that the distribution of the particles on the surface is between 20 and 250 particles per $mm^2$. This distribution may in particular be determined by topological analysis of the surface of the sheet obtained.

Preferably, the grammage of the sheet obtained will be between 50 and 500 $g/m^2$.

According to one embodiment, the weight of the layer on each coated side is between 3 and 30 $g/m^2$ by dry weight, preferably between 5 and 18 $g/m^2$ by dry weight.

In particular, the invention is characterized in that said layer comprises:

- 100 parts by dry weight of said particles;
- from 5 to 300 parts, preferably from 10 to 50 parts, by dry weight of a binder; and
- from 0 to 500 parts by dry weight of fillers.

In particular, the binder is chosen from styrene butadiene latices, acrylic latices, vinyl latices, dissolved starches, polyvinyl alcohol, proteins, especially casein, gelatin or soya protein, nitrocellulose, plastisol, glycerophthalic resins, epoxide resins, polyesters.

In particular, the fillers are chosen from calcium carbonate, kaolin, talc, titanium dioxide, barium sulfate, precipitated or pyrogenic silica, plastic pigments.

Other ingredients, such as waxes, rheology modifiers, antifoams, spreading agents, bactericides or fungicides, etc. may also be used in the coating composition.

These ingredients will not change the surface structure of the material and consequently the tactile effect obtained.

According to a final embodiment, the sheet possesses a dynamic friction coefficient measured according to the NF Q 03-082 standard on blotting paper of less than 0.5.

The invention also relates to the process for coating a sheet.

According to one particular case, the sheet coating process is characterized in that it comprises the following steps:

a) at least one side of the sheet is treated with a composition in aqueous medium, comprising:
   - 100 parts of incompressible microscopic particles that are bulky and have a rounded shape,
   - from 5 to 200 parts by dry weight, preferably from 10 to 50 parts by dry weight, of binder,
   - from 0 to 500 parts by dry weight of fillers;

b) the sheet obtained is dried.

According to one particular case of the process, step a) is carried out using a coating device chosen from roll coaters, of the helio or reverse roll type, which correspond to reverse roll coaters, trailing blade coaters, air knife coaters, film-transfer size presses, curtain coaters.

According to another particular case, step a) is carried out using a spray device.

According to another variant, the sheet coating process is characterized in that it comprises the following steps:

a) at least one side of the sheet is coated with a varnish comprising:
   - 100 parts of incompressible microscopic particles that are bulky and have a rounded shape,
   - from 5 to 200 parts by dry weight, preferably from 10 to 50 parts by dry weight, of binder,
   - from 0 to 500 parts by dry weight of fillers;

b) the sheet obtained is dried.

The invention also relates to the use of a sheet as described above for manufacturing a paper or plastic printing medium, a paper or plastic package, a cover intended for bookbinding, or a board or plastic box.

BRIEF DESCRIPTION OF THE DRAWINGS

The present invention will be explained further by means of examples accompanied by corresponding figures.

DETAILED DESCRIPTION OF PARTICULAR EMBODIMENTS

As seen above, by coating a paper with potato starch particles, the Applicant has succeeded in obtaining the "pleasant" rough feel that it sought, whereas this result is not obtained with corn starch grains.

By comparing FIGS. 1A, 1B and 2A, 2B, corresponding to the two types of starch mentioned above respectively, it is apparent that the distribution, the shape and the size of the grains allow this difference to be explained.

In the case of potato starch, the starch has a somewhat heterogeneous distribution on the sheet, small grains either aggregating around coarser grains or being deposited in an isolated and random fashion on the sheet.

In the case of corn, this distribution is however completely homogeneous on the sheet, the grains possessing relatively similar sizes and forming a finely grained thin layer on the paper.

Figure 1A:
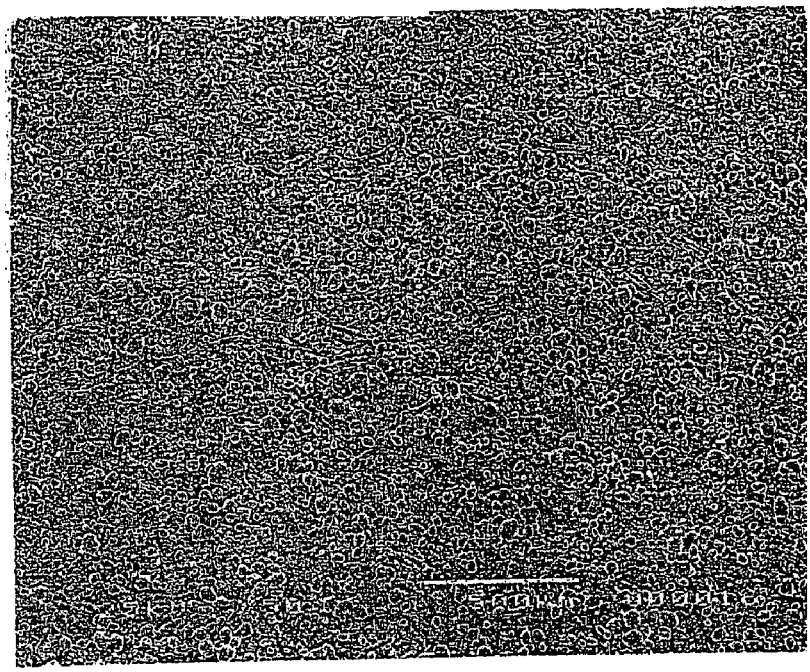
FIGS. 1A and 1B show scanning electron micrographs of a sheet of paper coated with potato starch grains with a 50× and 750× magnification, respectively.
Figure 1B:
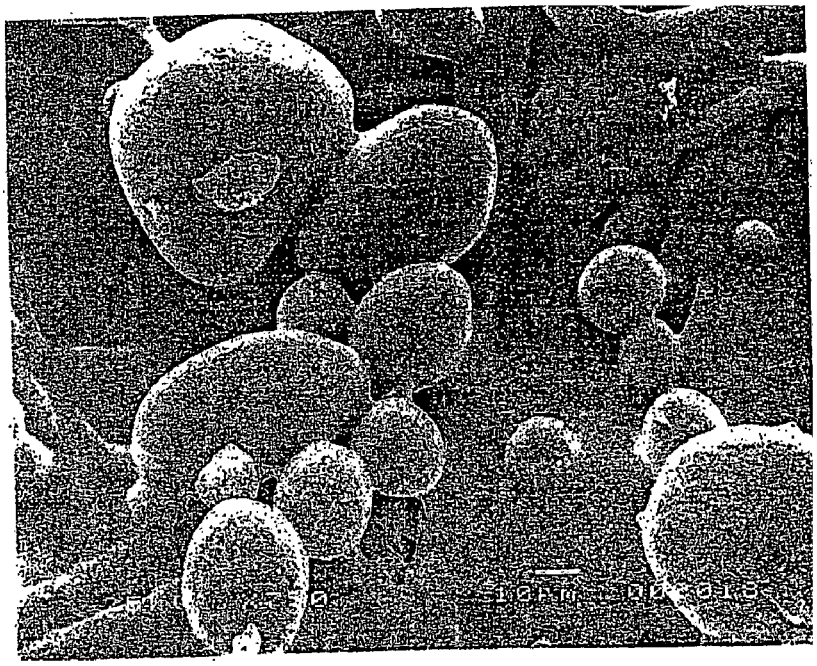
Figure 1C:
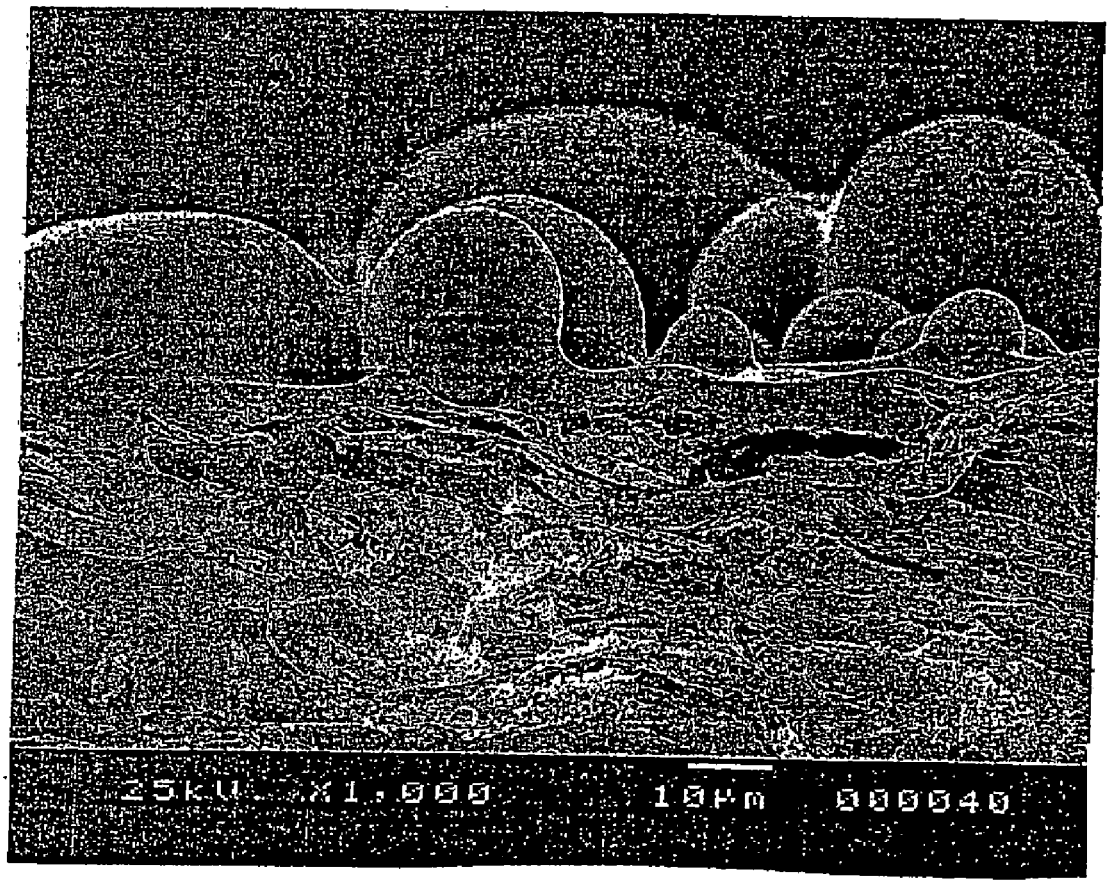
FIG. 1C shows the same sheet, but seen in section at 1000× magnification.
Figure 2A:
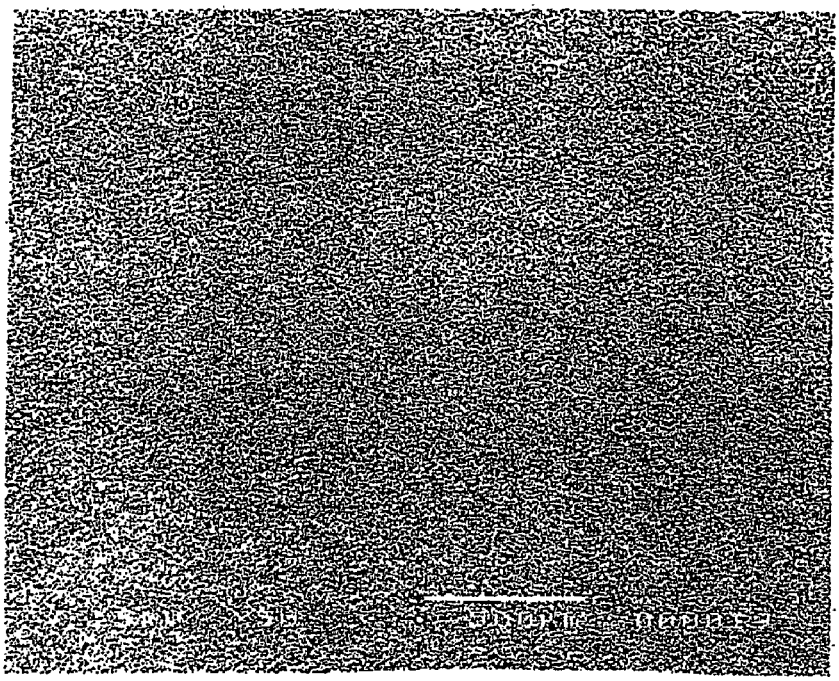
FIGS. 2A and 2B show a sheet of paper coated with corn starch grains at 50× and 750× magnification, respectively.
Figure 2B:
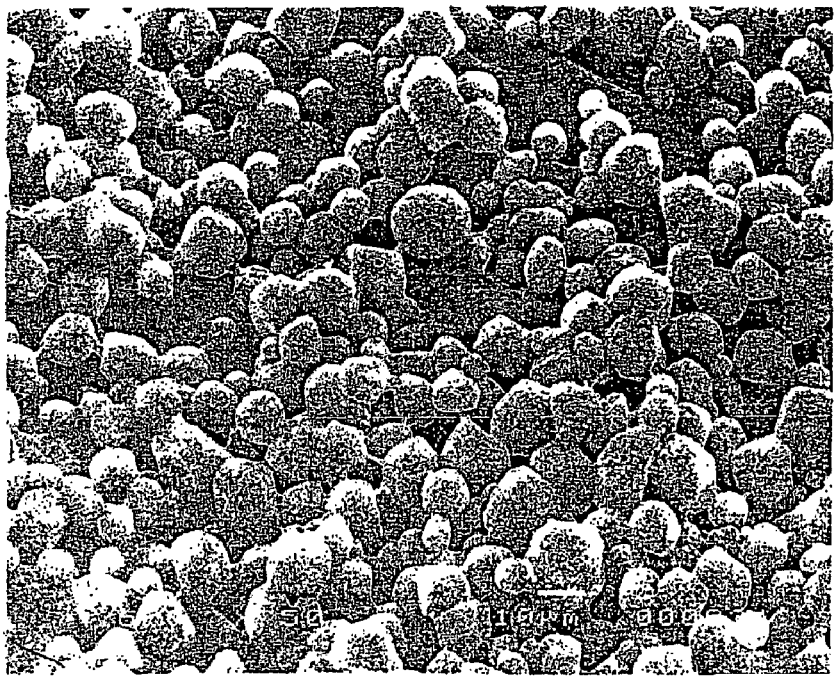
Figure 2C:
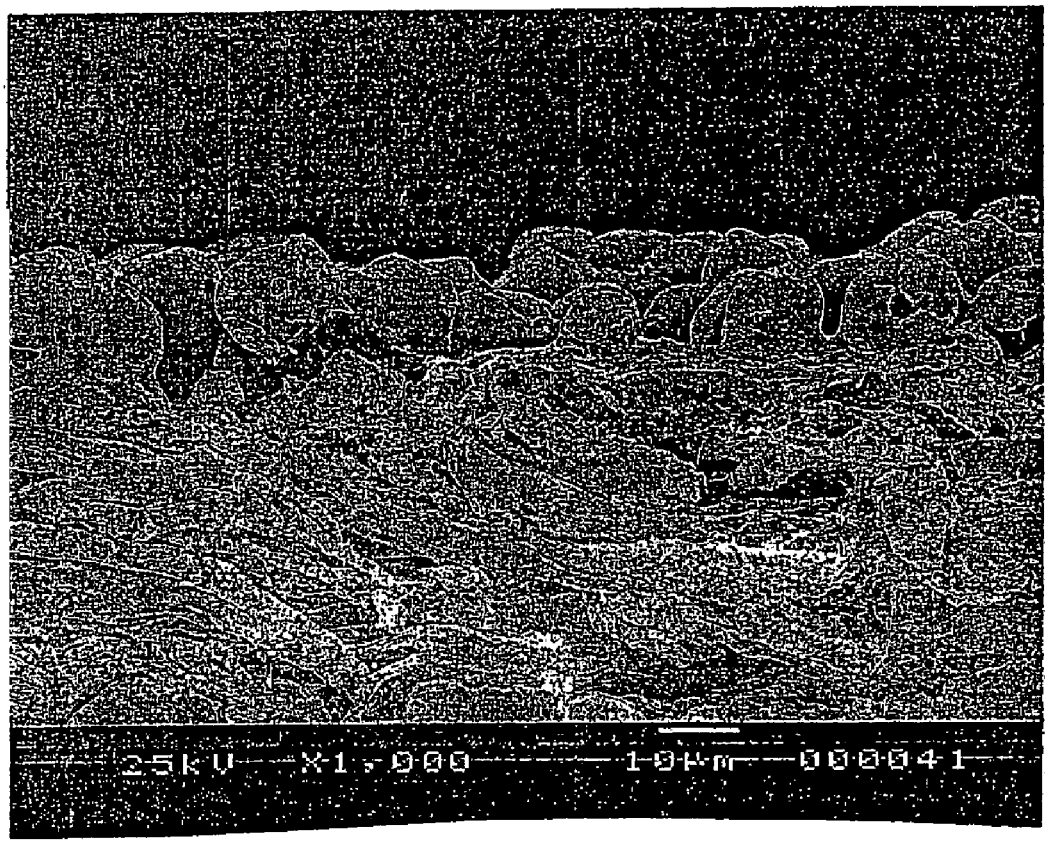
FIG. 2C shows the same sheet seen in section at 1000× magnification.

Comparing FIGS. 1C and 2C shows what a handler's finger will perceive when it is moved over the surface of the coated paper.

In the first case, his finger will pass from a hollow to a bump quite frequently, the height separating them being at least 25 micrometers.

In the second case, his finger will pass from one grain peak to another grain peak, the distance separating them being at most 10 micrometers.

Below about ten micrometers, it is difficult for a handler to appreciate the graininess of the surface and have any sensation of roughness.

The Applicant has also been able to observe an increased feeling of roughness by adding fillers, especially calcium carbonate.

Figure 3A:
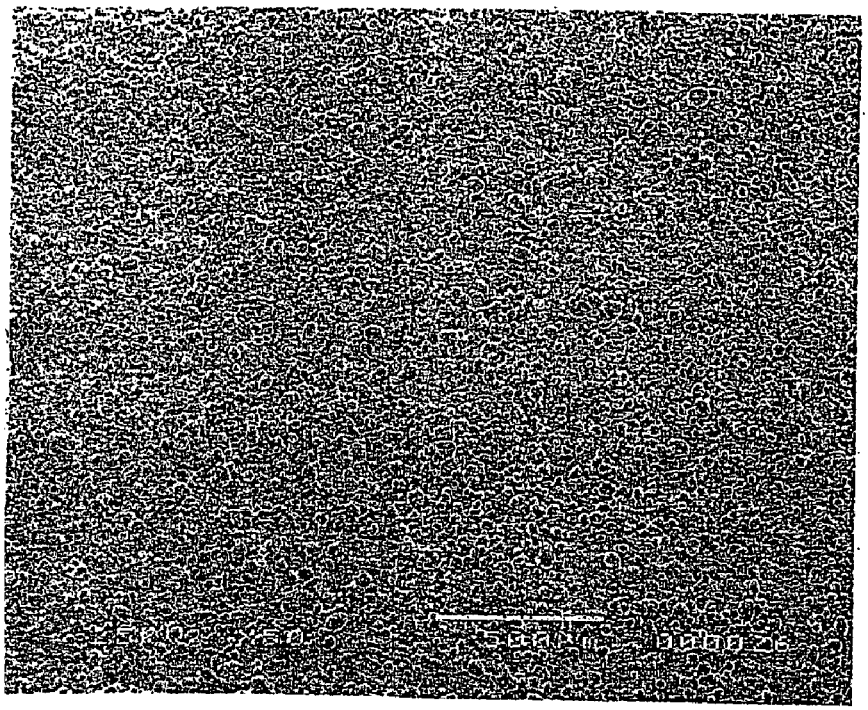
FIGS. 3A and 3B show a sheet of paper coated with potato starch grains and calcium carbonate as filler at 50× and 750× magnification, respectively.
Figure 3B:
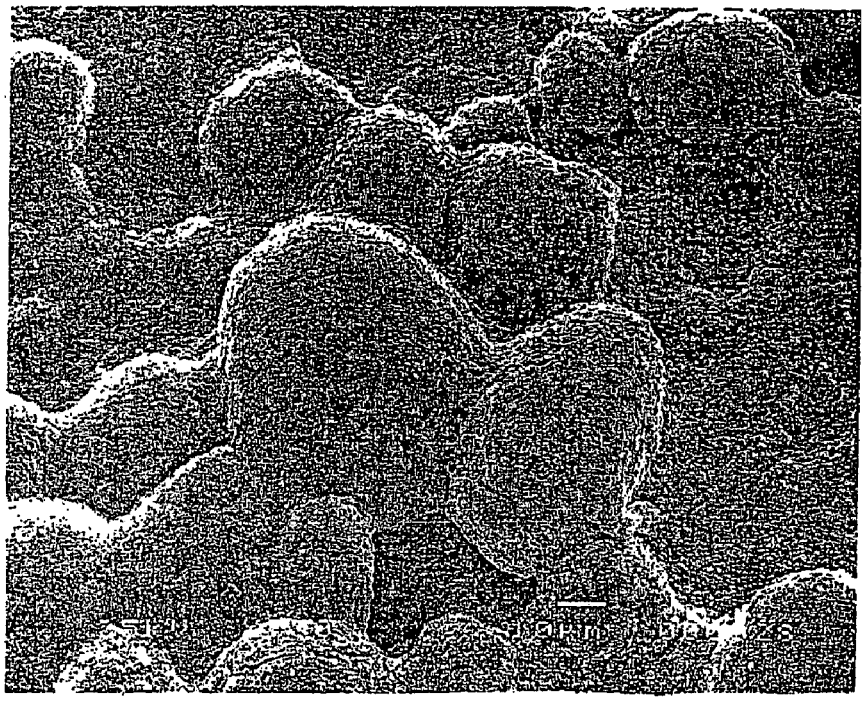
Figure 3C:
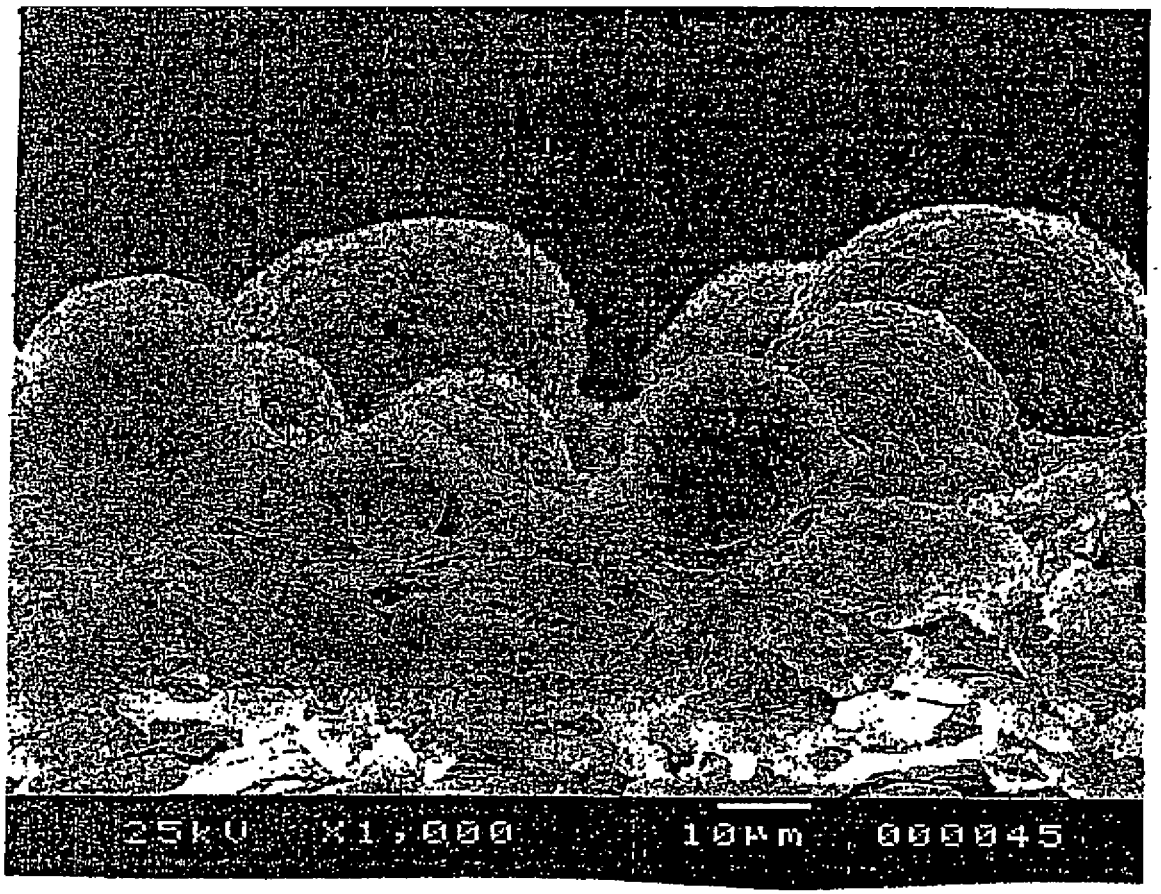
FIG. 3C shows the same sheet seen in section at 1000× magnification.

FIGS. 3A, 3B and 3C clearly show this aspect of the invention, since it may be seen that there is an unchanged distribution of the potato starch grains, but the appearance of these grains themselves is completely different.

In fact, calcium carbonate—a particle close to one micrometer in size—covers the surface of the starch grains, which thus lose their surface smoothness and become more catching to the touch.

Figure 4A:
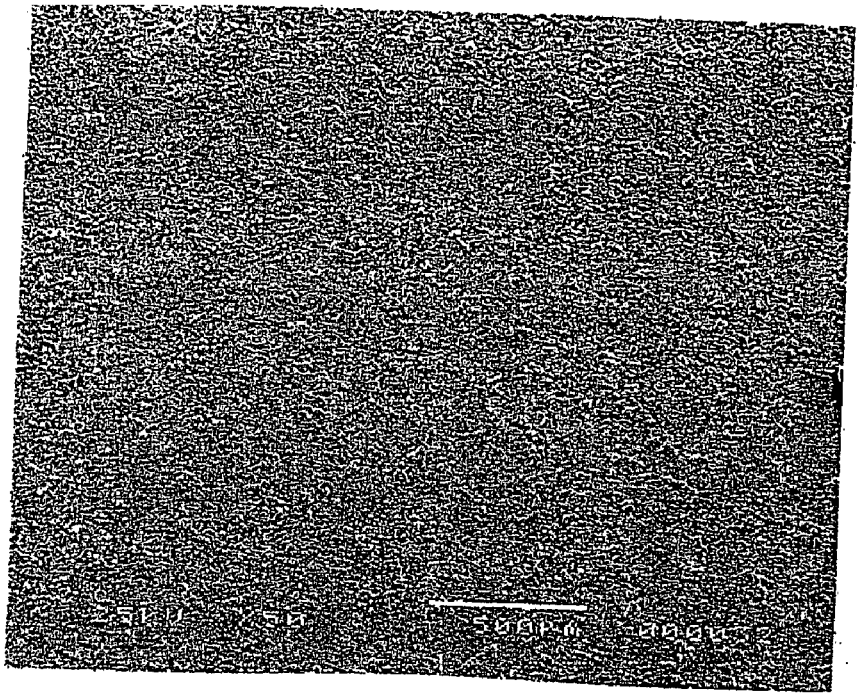
FIGS. 4A and 4B show a sheet of paper coated with silica particles at 50× and 750× magnification, respectively.
Figure 4B:
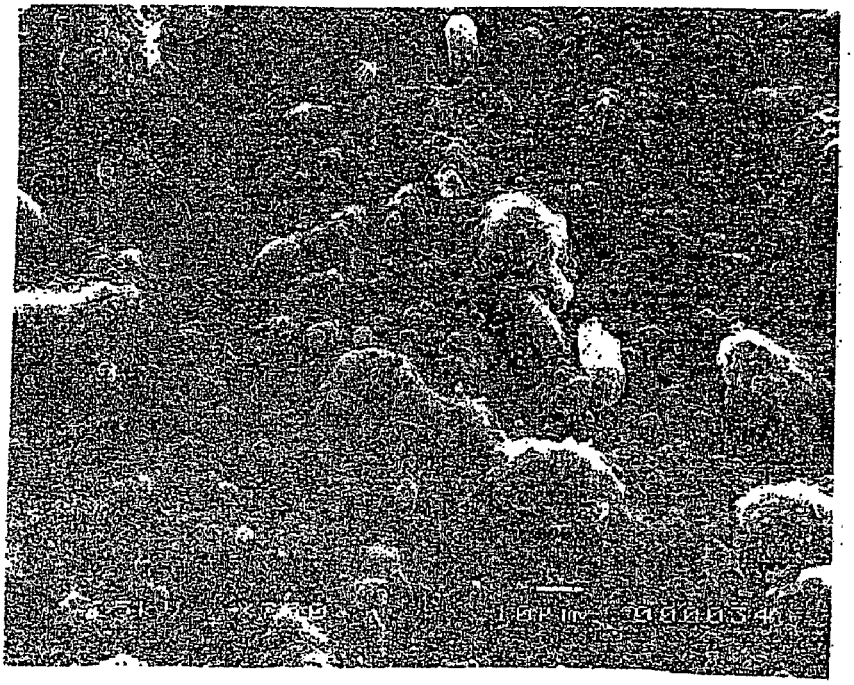
Figure 4C:
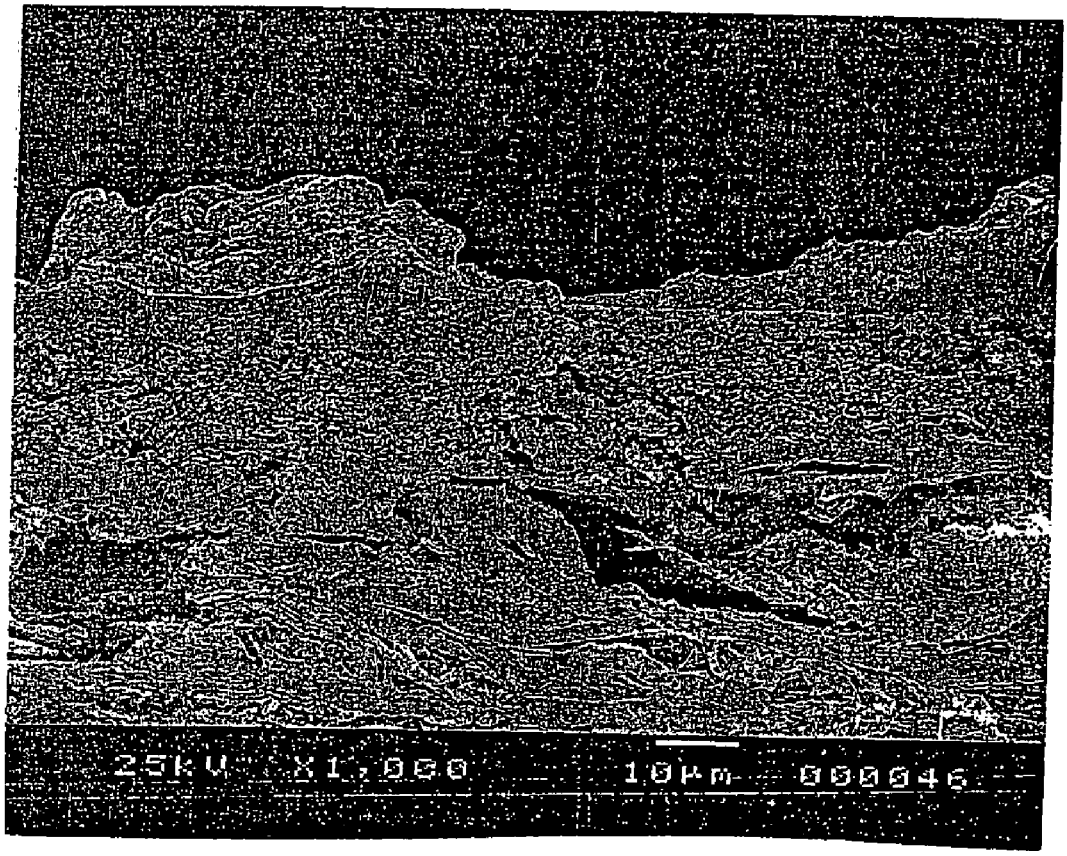
FIG. 4C shows the same sheet seen in section at 1000× magnification.

FIGS. 4A, 4B and 4C identify another case that the Applicant has intentionally excluded, that of a paper coated with angular silica particles.

In particular, FIG. 4C shows the very angular and uneven character of the silica particles, this being incompatible with a pleasant rough feel.

Although the sheet obtained nevertheless has a low degree of roughness, it owes this only to the small proportion of silica particles added and to the low relief thus created.

However, this feel does not correspond to the pleasant "rough" feel sought by the Applicant.

Figure 5:
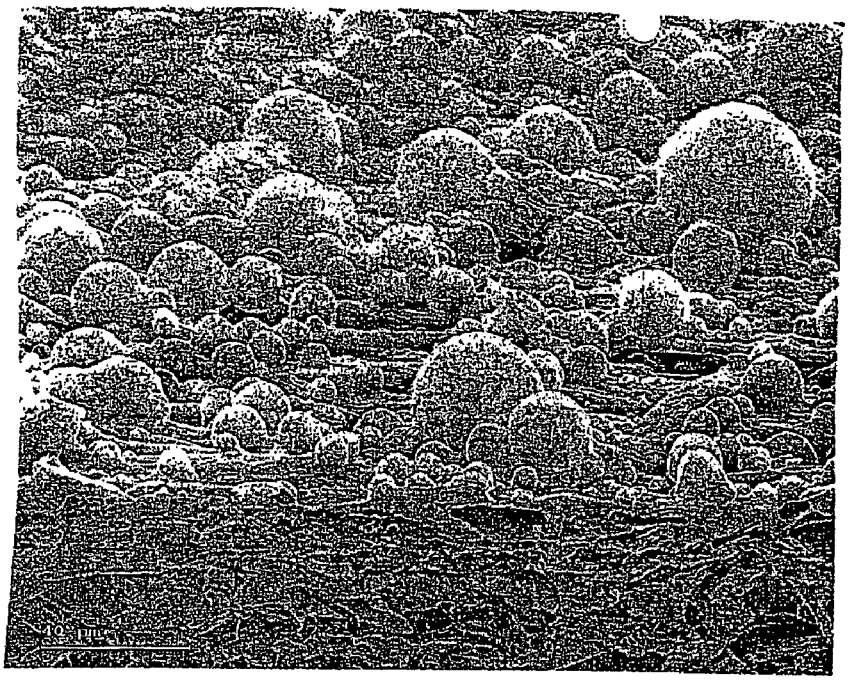
FIG. 5 shows a sheet of paper coated with expanded thermoplastic microspheres, of the EXPANCEL 820® type sold by Expancel at 500× magnification.

FIG. 5 for its part shows the surface of a sheet covered with expanded thermoplastic microspheres of the EXPANCEL type.

Examination shows that the particles are mostly small and almost spherical.

Since the coarse particles are both few in number and relatively soft, the "rough" effect sought is not obtained.

Figure 6:
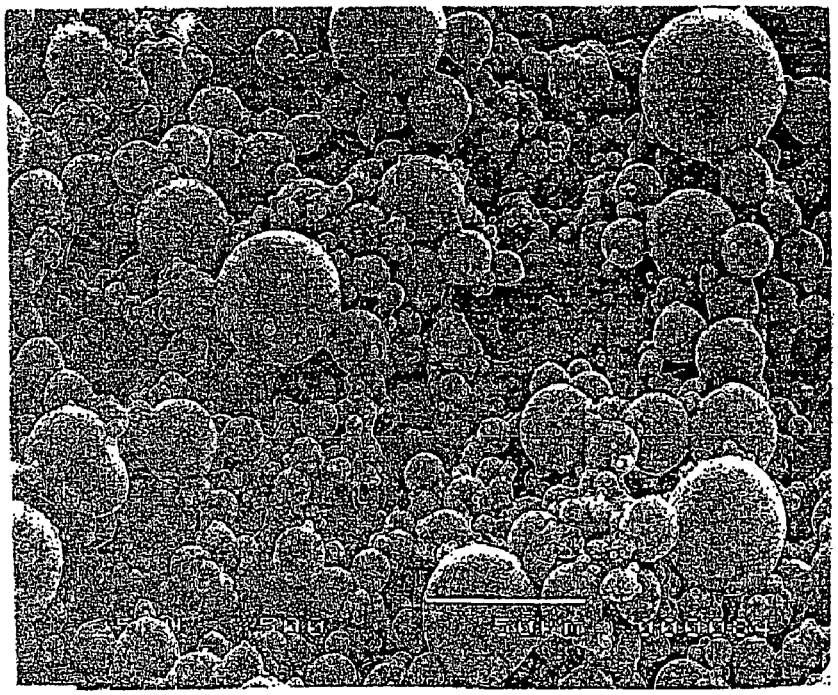
FIG. 6 shows a sheet of paper coated with glass microspheres at 500× magnification.

In contrast, FIG. 6 shows the surface of a sheet covered with glass microspheres.

Even though the distribution and the shape of the microspheres on the sheet have a certain similarity with the previous case, the feel obtained is completely different because of the hardness of the glass.

The feel is actually "rough" and not sticky as in the previous case.

Figure 7:
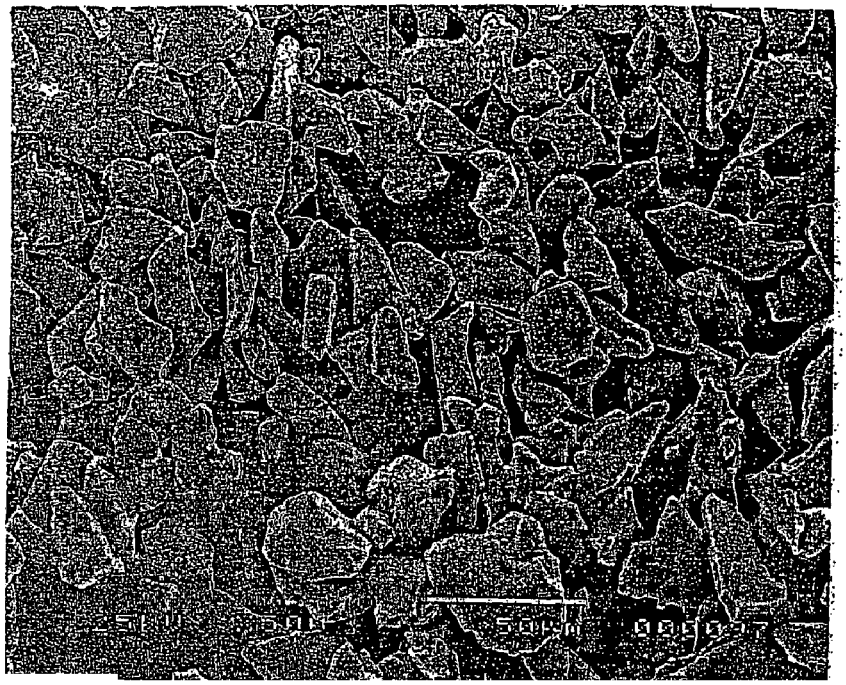
FIG. 7 shows a sheet of paper coated with alumina particles at 500× magnification.
Figure 8:
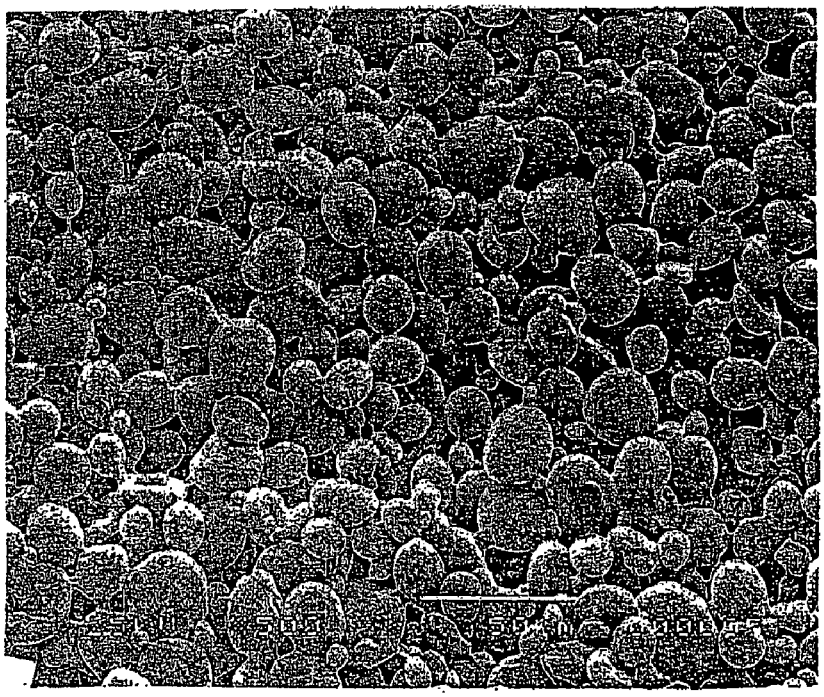
FIG. 8 shows a sheet of paper coated with wheat starch grains at 500× magnification.

FIGS. 7 and 8 confirm the fact that a pleasant "rough" feel cannot be obtained using alumina or wheat starch.

This is because, in one case, the excessively angular alumina particles give the surface a prickly character, unpleasant to the touch.

In the other case, the wheat starch produces a surface quite similar to that of corn starch; consequently, the rough character will practically be imperceptible.

Examples of coating compositions according to the invention are described below.

Example 1

A coating composition containing potato starch grains in an amount of 10.7 g/m$^2$ was applied to one side of a sheet of a paper medium using a laboratory size press.

The sheet thus treated was dried at about 150° C.

The composition containing the starch grains was produced in aqueous medium and contained, by dry weight:

100 parts of HICAT 110 (potato starch) sold by Roquette;
32 parts of ACRONAL S 305 D (latex) sold by BASF;
4.8 parts of AMP 90 (pH regulator) sold by Angus Chemie GmbH; and
6.7 parts of STEROCOLL D (thickener) sold by BASF.

The sheet shown in FIGS. 1A, 1B, 1C was obtained.

Example 2

A coating composition containing potato starch grains and calcium carbonate as fillers, in an amount of 22.5 g/m$^2$, was applied to one side of a sheet of paper medium using a laboratory size press.

The sheet thus treated was dried at about 150° C.

The composition containing the starch grains and calcium carbonate was produced in aqueous medium and contained, by dry weight:

100 parts of HICAT 110 (potato starch) sold by Roquette;
60 parts of HYDROCARB 90 (calcium carbonate) sold by OMYA;
32 parts of ACRONAL S 305 D (latex) sold by BASF;
4.8 parts of AMP 90 (pH regulator) sold by Angus Chemie GmbH; and
6.7 parts of STEROCOLL D (thickener) sold by BASF.

The sheet shown in FIGS. 2A, 2B, 2C was obtained.

Example 3

A coating composition containing glass microspheres, in an amount of 47 g/m$^2$, was deposited on one side of a sheet of paper medium using a laboratory sizing press.

The composition containing the glass microspheres was produced in aqueous medium and contained, by dry weight:

100 parts of MICROPERL 050-20-215 (glass microspheres) sold by 3M;
20 parts of ACRONAL S 360 D (latex) sold by BASF; and
2.4 parts of BLANOSE (thickener) sold by Aqualon.

The sheet shown in FIG. 6 was obtained.

The Applicant was also concerned to characterize the pleasant rough surface finish of the sheets obtained other than by a tactile appreciation made by a handler taken at random, a method that may be regarded as being too subjective.

With a concern to provide a specific and nonambiguous numerical value, the Applicant measured the dynamic friction coefficient according to French Standard NF Q 03-082.

The standard, based on measuring the tensile force needed to initiate and then sustain the movement of one surface over another, may be applied to the evaluation of a sheet of the material to be measured sliding over another (reference) material.

In its tests, the Applicant therefore chose as reference material a blotting paper, having a grammage of about 275 g/m$^2$, corresponding especially to the requirements of the ISO 5269-1 standard in its section 4.4.

Table I gives the measurements made on various coating compositions, by varying the particles introduced.

In view of the results, it may already be stated that the dynamic friction coefficient is higher the rougher the paper obtained.

In fact, it may be seen that the pleasant "rough" feel sought by the Applicant corresponds to a coefficient Kd of less than 0.5.

The particles such as thermally expanded microspheres of the EXPANCEL type, the alumina particles, the wheat starch grains or the rubber powder could therefore be excluded.

This confirms the observations made above.

TABLE I

| Particle type | Grammage of the medium (in g/m$^2$) | Weight of coating (in g/m$^2$) | Value of the friction coefficient Kd |
|---|---|---|---|
| Potato starch | 249 | 16 | 0.31 |
| Potato starch + $CaCO_3$ | 249 | 17 | 0.28 |
| EXPANCEL | 120 | 2 | 0.87 |
| Glass microspheres | 249 | 18 | 0.35 |
| Ground polyamide | 249 | 12 | 0.41 |
| Alumina | 249 | 15 | 0.61 |
| Wheat starch | 249 | 13 | 0.31 |
| Rubber powder | 249 | 31 | 0.97 |

The invention claimed is:

1. A printable sheet comprising at least one side coated with a layer comprising incompressible microscopic potato starch particles that are bulky and have a rounded shape, wherein the potato starch particles have a weight-average diameter of greater than 25 micrometers and have heterogeneous, sizes and shapes, wherein the layer forms an outside surface of the sheet, and wherein at least some of said particles protrude from said outside surface, said protruding particles defining bumps and hollows on said outside surface with a height separating them of at least 25 micrometers, wherein said particles are in a proportion of from 12.5% to 69.7% by dry weight relative to a total dry weight of the layer, wherein said layer comprises a binder in a proportion of from 15.7% to 75% by dry weight relative to the total dry weight of the layer, wherein said layer comprises fillers in a proportion of from 0% to 62.5% by dry weight relative to the total dry weight of the layer, and wherein said coated side has a rough surface feel.

2. The sheet as claimed in claim 1, wherein the particles have a weight-average diameter of less than 200 micrometers.

3. The sheet as claimed in claim 1, wherein the particles have a spherical shape.

4. The sheet as claimed in claim 1, wherein the sheet comprises nongelatinized starch grains.

5. The sheet as claimed in claim 1, wherein the sheet comprises particles obtained from grinding a plastic.

6. The sheet as claimed in claim 1, wherein the distribution of the particles on the surface is between 20 and 250 particles per $mm^2$.

7. The sheet as claimed in claim 1, wherein said sheet is a paper sheet having a grammage of between 50 and 500 $g/m^2$.

8. The sheet as claimed in claim 1, wherein the weight of said layer on each coated side is between 3 and 30 $g/m^2$ by dry weight.

9. The sheet as claimed in claim 1, wherein the binder is chosen from styrene butadiene latices, acrylic latices, vinyl latices, dissolved starches, polyvinyl alcohol, proteins, especially casein, gelatin or soya protein, nitrocellulose, plastisol, glycerophthalic resins, epoxide resins, polyesters.

10. The sheet as claimed in claim 1, wherein the layer comprises fillers are chosen from calcium carbonate, kaolin, talc, titanium dioxide, barium sulfate, precipitated or pyrogenic silica, plastic pigments.

11. The sheet as claimed in claim 1, wherein its dynamic friction coefficient measured according to the NF Q 03-082 standard on blotting paper is less than 0.5.

12. Method of manufacturing an object selected from a paper or plastic printing medium, a paper or plastic package, a cover intended for bookbinding, or a board or plastic box, comprising providing a sheet as claimed in claim 1 and manufacturing the object incorporating said sheet.

13. The sheet as claimed in claim 1, wherein the layer does not comprise any fillers.

14. The sheet according to claim 1, wherein the layer comprises a pH regulator and/or a thickener.

15. The sheet according to claim 1, wherein the layer comprises at least 32 parts of binder for 100 parts of particles, by dry weight.

16. The sheet according to claim 1, wherein the proportion of the binder is from 22% to 75% by dry weight relative to the total dry weight of the layer.

17. The sheet as claimed in claim 8, wherein the weight of said layer on each coated side is between 5 and 18 $g/m^2$ by dry weight.

18. The sheet according to claim 10, wherein the layer comprises up to 60 parts of fillers for 100 parts of particles, by dry weight.

19. The sheet according to claim 15, wherein the layer comprises from 32 to 200 parts of binder for 100 parts of particles, by dry weight.

20. A process for coating a sheet as claimed in claim 1, comprising the following steps:

a) at least one side of the sheet is treated with a varnish or with a composition in aqueous medium to form a layer forming an outside surface of the sheet, said varnish or composition comprising:

incompressible microscopic potato starch particles that are bulky and have a rounded shape, wherein the potato starch particles have a weight-average diameter of greater than 25 micrometers and have heterogeneous sizes and shapes, said particles being in a proportion of from 12.5% to 69.7% by dry weight relative to a total dry weight of the layer, a binder in a proportion of from 15.7% to 75% by dry weight relative to the total dry weight of the layer, and fillers in a proportion of from 0% to 62.5% by dry weight relative to the total weight of the layer, b) the sheet thus obtained is dried, wherein said particles protrude from said outside surface of said sheet, and wherein said protruding particles define bumps and hollows on said outside surface with a height separating them of at least 25 micrometers.

21. The coating process as claimed in claim 20, wherein step a) is carried out using a coating device chosen from roll coaters, of the helio or reverse roll type, trailing blade coaters, air knife coaters, film-transfer size presses, curtain coaters.

22. The coating process as claimed in claim 20, wherein step a) is carried out using a spray device.

23. The coating process as claimed in claim 20, wherein the distribution of the particles on the surface is between 20 and 250 particles per $mm^2$.

* * * * *